US006123142A

United States Patent [19]

Ratte

[11] Patent Number: 6,123,142

[45] Date of Patent: Sep. 26, 2000

[54] METHOD OF MOLDING ARTICLES TO MINIMIZE SHRINKAGE AND VOIDS

[75] Inventor: Leon J. Ratte, White Bear Lake, Minn.

[73] Assignee: Water Gremlin, White Bear Lake, Minn.

[21] Appl. No.: 08/980,222

[22] Filed: Nov. 28, 1997

Related U.S. Application Data

[62] Division of application No. 08/451,453, May 26, 1995, Pat. No. 5,758,711.

[51] Int. Cl.[7] ..... B22D 17/12; B22D 17/20; B22D 17/30

[52] U.S. Cl. ..... 164/65; 164/113; 164/120; 164/133

[58] Field of Search ..... 164/113, 120, 164/133, 136, 62, 65, DIG. 1

[56] References Cited

U.S. PATENT DOCUMENTS 5,170,835 12/1992 Eberle et al. ..... 164/133 X

FOREIGN PATENT DOCUMENTS 3401354 7/1985 Germany ..... 164/133
61-189860 8/1986 Japan ..... 164/133

*Primary Examiner*—J. Reed Batten, Jr.
*Attorney, Agent, or Firm*—Jacobson & Johnson

[57] ABSTRACT

Molten material is elevated into a mold cavity and subsequently pressure is brought to bear on the molten material in the mold cavity substantially immediately to solidify the molten material under pressure. The molten material is tapped from a reservoir of molten material below the surface of the molten material to minimize exposure to air of the molten material and transferred to the mold cavity without a downward flow or a pouring of the tapped molten material.

16 Claims, 2 Drawing Sheets

METHOD OF MOLDING ARTICLES TO MINIMIZE SHRINKAGE AND VOIDS

This application is a division of application Ser. No. 08/451,453, filed May 26, 1995 and now U.S. Pat. 5,758, 711.

FIELD OF THE INVENTION

The present invention relates generally to a method for molding, particularly to a method for molding by elevating molten material into a die cavity, and specifically to a method for molding by elevating the molten material, such as molten lead, into the die cavity and subsequently bringing pressure to bear on the molten material during solidification of the die cavity to solidify the molten material to produce an article free of voids and cracks and having an outer surface with a cold rolled appearance.

BACKGROUND OF THE INVENTION

Shrinkage, cracking, voids, pores, poor density, and lamination or skin formation are problems in the art of molding. Shrinkage is a decrease in volume of the material being molded as the material cools from a molten to a solid. Cracking is the result of shrinkage; cracking is the formation of cracks in the cooled and solid molded product. Porosity may also be caused by shrinkage. Voids, pores, and poor density may further be caused by turbulent flow of the molten material. Simply pouring molten material is relatively highly turbulent. Lamination is the formation in a molded product of two or more layers of the same material; the two or more layers are caused by different portions of the molten material cooling at different times. One type of lamination is the formation of skin. This occurs when the molten material which is in contact with the relatively cool cavity wall cools prior to the molten material not in contact with cavity surfaces. One area where the problem becomes acute is in the formation of lead battery terminals for batteries as any voids or cracks in the battery terminals can cause the terminals to leak acid.

Pouring causes problems other than poor density. For example, pouring—especially hand pouring—is slow. Too much time elapses before solidification progresses to the point of no movement for pressure to be brought to bear timely on the metal in the cavity.

Accordingly, general objects of the invention are to provide a unique method and apparatus for molding metal which minimizes the number of pores and voids in the final product and maximizes the density of and a smooth finish to the final product.

Another object of the invention is to provide such a method which uniquely includes the step of feeding without pouring a charge of molten metal to a location between a punch and die cavity. A shuttle slides a shot or charge of the molten material from a reservoir to the punch and die cavity. Such contributes to the formation of a product which is air free and dense.

Another object of the invention is to provide such a method which uniquely includes the step of elevating a charge of molten material into a mold cavity to avoid a pouring of the molten material and minimize the turbulence of the charge. A punch is driven vertically and relatively quickly and gently to lift the charge into the mold cavity without any turbulence or atomization and with minimal loss of heat. Such further contributes to a product which is air free and dense.

Another object of the invention is to provide such a method which uniquely includes the step of immediately applying pressure to the molten material. Pressure is applied to the molten material within one-quarter of a second after the material has been elevated into the cavity and prior to the solidification of any of the molten material.

Another object of the invention is to provide such a method which uniquely delivers a precise quantity to a mold cavity. The shot or charge of molten material is measured twice, once when the charge is collected from a reservoir of molten material and a second time when a punch elevates the charge into the charge cavity. Accordingly, pressure can be applied to the precisely measured charge immediately after the charge has been introduced to the cavity, machining of the final product is minimized, and molten metal is conserved.

Another object of the invention is to provide such a method which is uniquely carried out in an air-free environment. Specifically, charges of molten material are collected from below the surface of a reservoir of the molten material, then transferred to the punch and die assembly with minimal exposure to air, and then elevated into the die cavity under vacuum.

Another object of the invention is to provide a unique reservoir and shuttle assembly for loading a charge of molten material on the shuttle for transfer to the punch and mold assembly. The shuttle includes a through hole which communicates with the inside of the reservoir below the surface of the molten material. Molten material flows upwardly into the hole from the bottom opening of the hole to minimize a pouring of the material. The shuttle then slides the charge out of the reservoir to the punch and mold assembly. While sliding back and forth between the reservoir and punch and mold assembly, the shuttle remains sealingly engaged with a wall of the reservoir.

Another object of the invention is to provide such a method which uniquely retains the heat of the charge until the step of applying pressure to the molten material. Specifically, the disc shape of the body of the charge minimizes the amount of surface area exposed to further minimize the loss of heat during the steps of feeding and elevating. The punch and shuttle are driven sufficiently quickly from a reservoir of molten material to minimize the loss of heat from the charge.

Another object of the invention is to provide metal products having thin walls of less than one-eighth of inch in thickness and having a smooth finish and high density.

These and further objects and advantages of the present invention will become clearer in light of the following detailed description of an illustrative embodiment of this invention described in connection with the drawings.

DESCRIPTION OF THE PRIOR ART

The Mallach U.S. Pat. No. 2,500,556 shows a pouring of metal and teaches that it is important that at least an initial fraction of the mold closing movement be performed while the metal is still flowing through the mold.

The Hall et al. U.S. Pat. No. 3,344,848 teaches the steps of admitting a measured charge of molten metal into a shot sleeve, operating a duplex plunger as a unit to move molten metal non-turbulently into a die cavity in the form of a solid front, maintaining a relatively high compacting pressure on the molten metal by means of the duplex unit until a relatively thin shell of molten metal has solidified adjacent the walls of the die cavity, the gating, and the duplex plunger tip to prevent further application of compacting pressure and thereafter actuating the smaller plunger independently of the larger one whereby its tip breaks through the solidified metal shell adjacent the tip of the smaller plunger to thereby subject the molten core portion of the metal in the die cavity to continued high pressure and continued filling until the metal has solidified. It is disclosed that atmospheric air in the die cavity is expelled through die vents ahead of the rising front of molten metal thus minimizing casting porosity due to air entrapment.

The Carr U.S. Pat. No. 3,534,802 discloses ladling or pouring molten metal into an upper chamber. It also teaches a vertical injection chamber in which very little, if any, air can be entrapped or occluded in the charge. It discloses that instead, air is displaced from the chamber as the material is charged thereto, thereby significantly reducing the possibilities of excessive porosity in the final casting.

The Lauth U.S. Pat. No. 3,554,272 teaches a pouring of a charge of molten metal into a well 82, the lower end of which is closed by piston 82. Piston 82 is subsequently driven upwardly to force molten metal out of well 82 outwardly along grooves and thence upwardly through passages into the various die cavities.

The Yanagisawa et al. U.S. Pat. No. 3,945,428 teaches a pouring of molten metal into the forming die.

The Lynch U.S. Pat. No. 4,049,040 teaches multiple squeeze casting punch dies to be connected together and operated by a common press, despite variations in the quantities of molten metal poured into multiple die cavities.

The Allen U.S. Pat. No. 4,592,405 teaches die parts which may be engaged or locked together.

The Ouimet U.S. Pat. No. 4,779,665 teaches the pouring of a charge of molten metal into a shot sleeve and then advancing a shot plunger to inject metal through a runner which is shown to be vertically disposed.

The Suzuki U.S. Pat. No. 5,074,352 teaches a pouring into a casting mold.

The Frulla U.S. Pat. No. 5,143,141 teaches pouring a metered amount of molten metal into a casting cavity through a duct which leads into the cavity.

The Ivansson U.S. Pat. No. 5,343,927 teaches pouring molten metal into a filling chamber which receives a lower piston which subsequently is pressed upwards to carry out a basic feeding into a mold cavity.

HPM Corporation of Mount Gilead, Ohio has published a brochure relating to thixomolding machine having a melting chamber with an argon atmosphere. Further, the machine appears to push a semi-solid alloy upwardly in a mold.

SUMMARY OF THE INVENTION

Briefly, the invention comprises a method for molding is disclosed which includes the steps of moving a charge of molten metal to a position where one can elevate a metered amount of molten material into a mold cavity and subsequently bringing pressure to bear on the molten material in the mold cavity substantially immediately so that the solidification process takes place under pressure to produce a final product free of cracks and laminations with a smooth exterior surface.

DESCRIPTION OF THE PREFERRED EMBODIMENTS

Figure 1:
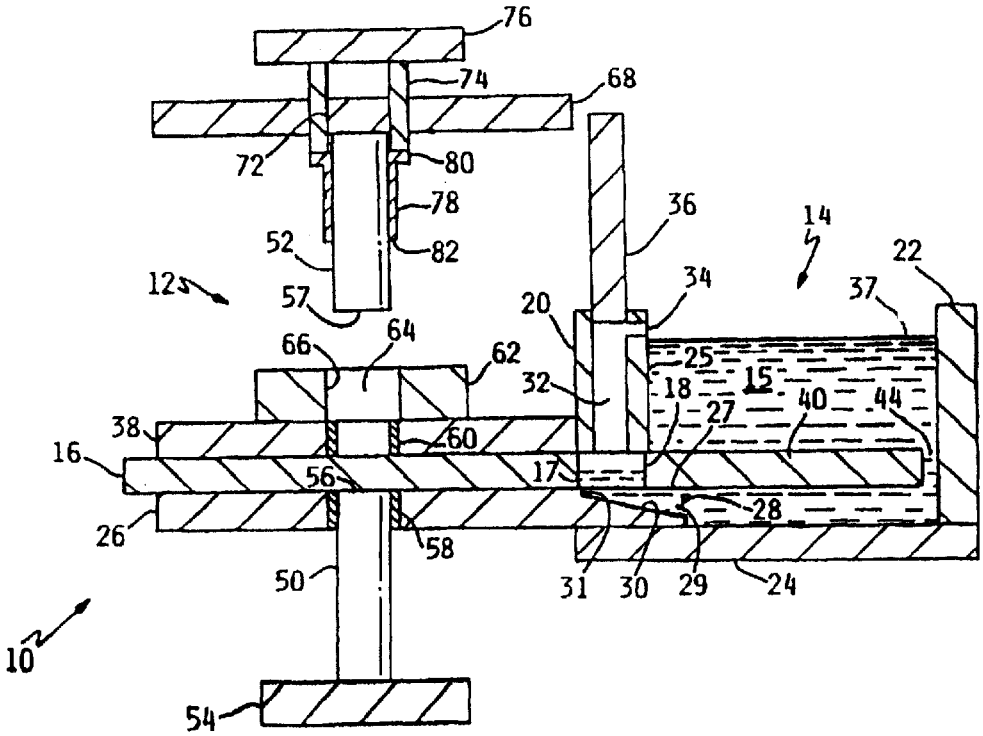
FIG. 1 shows a side diagrammatic view of the molding apparatus of the present invention, with a charge of molten material being loaded onto the shuttle.

Referring to FIG. 1, reference numeral 10 generally identifies a molding apparatus of the present invention. The molding apparatus 10 includes a punch and mold cavity assembly 12 fixed adjacent to a reservoir 14 of molten material 15 and a shuttle 16 with a charge or shot opening 17 for transferring a shot or charge 18 of molten material to the punch and mold cavity assembly 12.

More particularly, the reservoir or pot 14 includes sidewall portions 20, 22 and a bottom 24. Preferably the reservoir is box like in shape with four sidewalls and a square or rectangular bottom. Sidewall portion 20 includes an inner wall portion 25. The reservoir 14 is rigidly affixed, such as by bolts, to a lower support plate 26 extending between the reservoir 14 and the punch and mold cavity assembly 12. The lower support plate includes an upper surface 27. An end 28 of the support plate 26 extends into the reservoir 14 and lies on the upper surface of the bottom 24. Plate 26 is bolted to bottom plate 24. The plate end 28 includes a fluid intake or fill 29 formed by a beveled or angular upper edge portion 30 and the lower surface of the shuttle 16. The intake 29 acts like a funnel for directing or funnelling molten material 15 into the hole 17 in the shuttle 16. Edge 30 leads into a vertically extending edge 31. Edge 31 may be tailored to be flush with at least a portion of the lower round edge of hole 17.

Figure 2:
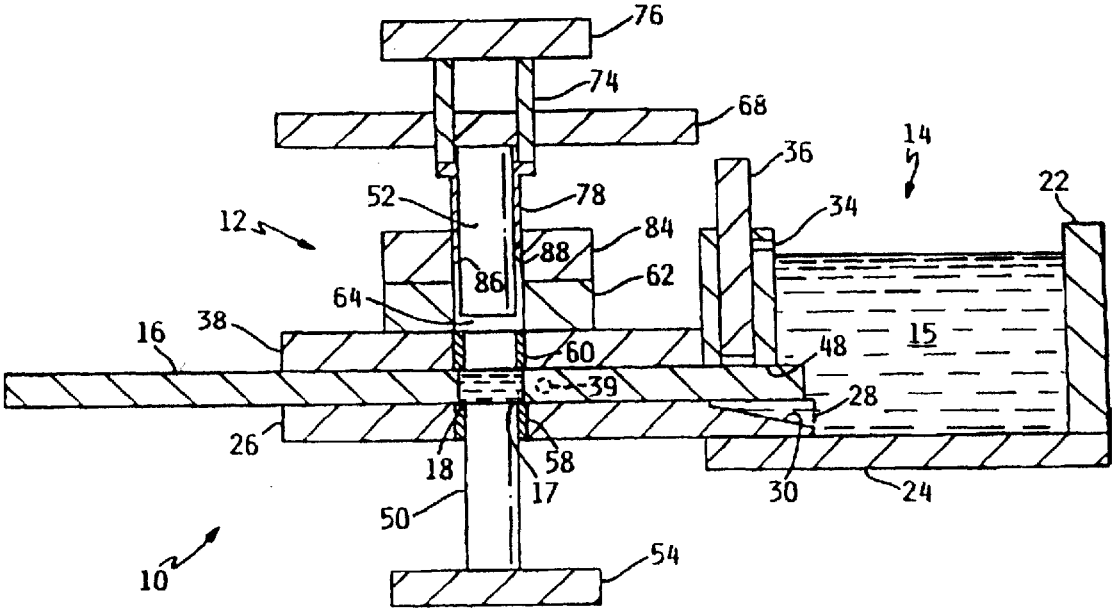
FIG. 2 shows a side diagrammatic view of the molding apparatus of FIG. 1, with the charge of molten material being aligned on the head of a punch to be vertically driven.
Figure 3:
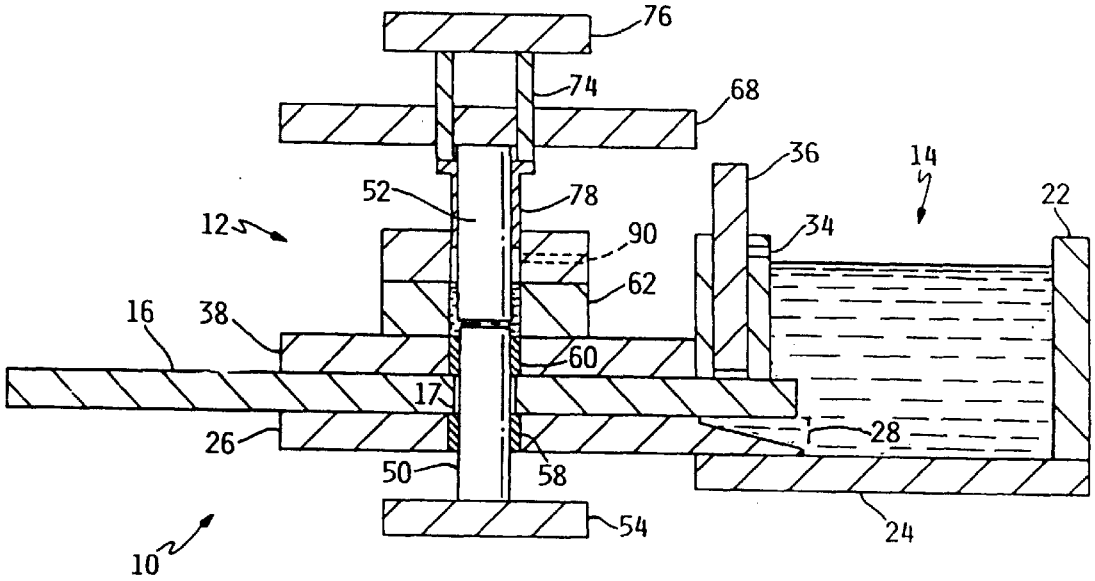
FIG. 3 shows a side diagrammatic view of the molding apparatus of FIG. 1, with the charge of molten material having been fed by the punch into the mold cavity.
Figure 4:
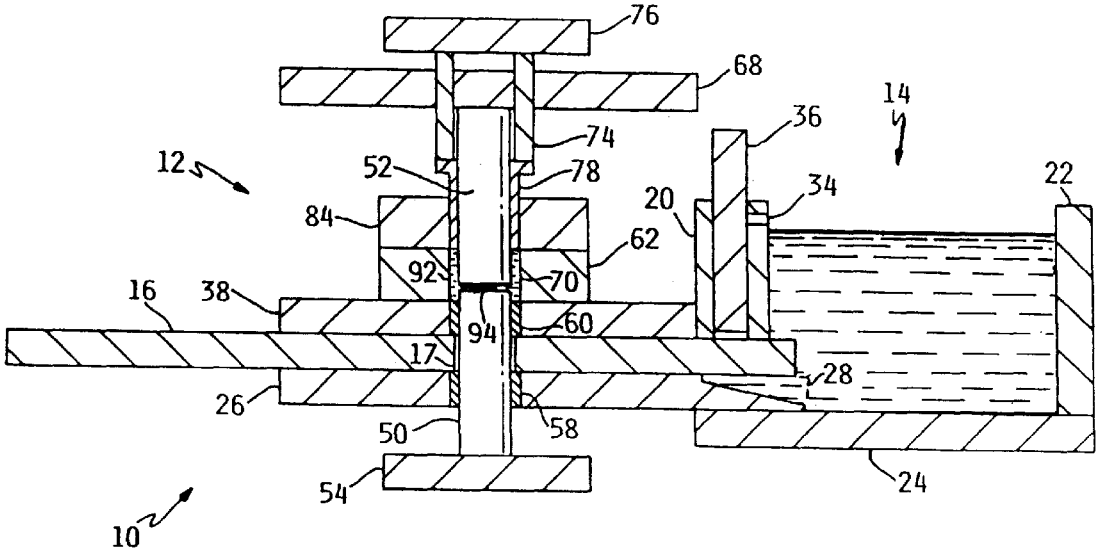
FIG. 4 shows a side diagrammatic view of the molding apparatus of FIG. 1, with the apparatus applying pressure to the charge of molten material in the mold cavity.

Sidewall portion 20 includes a vertically extending vent hole 32 communicating with a horizontally extending outlet 34. Slidingly and sealingly engaged in the vent hole 32 is a cylindrical shaft 36. When the shaft 36 is in its upper open position as shown in FIG. 1, air may be expelled from the hole 32 through the outlet 34. When the shaft 36 is in its lower closed position as shown in FIGS. 2, 3, and 4, the vent hole 32 and the shuttle hole 17 is closed to the atmosphere. When the shuttle 16 returns from the punch and mold cavity assembly 12 with a hole 17 which may be empty except for air, shaft 36 is moved to its open position to permit air to be expelled from the hole 17 via the vent hole 32 and the outlet 34. Subsequently and immediately after the air is expelled from the vent hole 32 such as with the aid of a vacuum, the shaft 36 is returned to its closed position to minimize the exposure of the charge 18 to air. The molten material 15 includes a surface 37 at a level below the outlet 34.

The shuttle 16 is a relatively long rectangular plate which slides and is supported between the lower support plate 26 and an upper second support plate 38. As shown in FIG. 2, the width of the shuttle 16 is sufficient to provide space therein for the placement of cartridge heaters 39 at least about and adjacent to the metering hole 17 to supply heat to the charge 18 in the hole 17. The length of the shuttle 16 is sufficient such that one end of the shuttle 16 seals the reservoir 14 when the shuttle 16 is in the shot position to prevent any metal leaving the reservoir 14 other than the metal of the charge 18 in the metering hole 17.

The second support plate 38 is rigidly affixed, such as with bolts, to the sidewall portion 20 of the reservoir 14 and is held apart from lower support plate 26 by parallel spacers. Accordingly, the shuttle 16 is confined to slide between a shot position at the assembly 12 to a fill position at the reservoir 14. The support plates 26 and 38 seal the shuttle 16 relative to the reservoir 14. The shuttle 16 includes an end plate portion 40 which also partakes in sealing the reservoir 14 as at least some section of the end plate portion 40 remains engaged between the sidewall portion 20 and the end 28 of the lower support plate 26 when the shuttle transfers the charge 18 to and from the punch and mold cavity assembly 12. If the reservoir 14 is filled by a pouring action, the shuttle plate portion 40 guards against such turbulence being directed into the beveled intake 30.

End plate portion 40 includes an edge 42 which remains spaced from the inner surface of sidewall portion 22 when the charge hole 17 is aligned with the sidewall portion 20. Such a space is identified by reference numeral 44. Space 44 permits molten material 15 to flow below shuttle 16 and subsequently into the charge hole 17 via the beveled end 28. A lower edge 48 of inner sidewall portion 25 remains sealingly engaged with the shuttle 16 when the shuttle 16 is in its loading position as shown in FIG. 1 such that molten material 15 is prevented from flowing into the charge hole 17 from above the shuttle 16. Accordingly, the charge hole 17 is filled gently from the bottom up without a pouring of the molten material and without exposure to the atmosphere below the surface 37. From the reservoir 14, the charge or shot 18 is transferred by the shuttle 16 to the punch and mold cavity assembly 12.

The punch and mold cavity assembly 12 includes the lower and upper support plates 26 and 38, and the shuttle 16 and further includes lower and upper respective punches 50, 52. A mount 54 is engaged with and provides the controlled travel for the lower punch 50. The punches 50, 52 are cylindrical and include respective cylindrical heads 56, 57. The punches 50, 52 form the inner and bottom configuration of the final product.

The assembly further includes annular carbide sleeves or bushings 58 and 60 retained respectively in the lower and upper support plates 26 and 28. Bushing 58 provides a bottom seal. Bushing 60 meters the quantity of the charge 18 pushed upwardly as the charge 18 is elevated by the punch 50. It should be noted that the charge hole 17 is typically closely aligned with the support plate sleeves 58 and 60 such that the charge 18 is elevated substantially in its disk like form and such that the charge 18 encounters minimal resistance from the sleeve 60 as it is elevated. Accordingly, as the punch 50 is also elevated relatively slowly, the charge 18 is elevated with zero turbulence.

The assembly 12 further includes a cavity plate 62 fixed to the upper surface of the upper support plate 38. The cavity plate 62 includes a cylindrical cavity 64 formed by a cylindrical sidewall 66. The cavity 64 includes a diameter larger than the diameter of the bushing 60 and lower and upper punches 50 and 52. The cavity 64 forms the outer shape of the final product.

The assembly 12 further includes a plate 68 for positioning the punch 52 at closure, when the punch is driven into cavity 64 for forming the inside diameter or inside shape of a final product 70. The plate 68 includes three pin guides or holes 72 for slideably receiving and guiding pins 74 driven by a plate 76. When a force is imparted to the pins 74 by the plate 76, the pins 74 in turn impart a force to an annular sleeve 78 surrounding and slideable on upper punch 52. The annular pressure applying sleeve 78 includes an upper annular flange 80 for receiving the force imparted by the pins 74. A lower annular end 82 of the sleeve 78 in turn imparts a force to the charge 18 in the cavity 64 to solidify the charge 18.

The assembly 12 further includes a compression housing 84, shown in FIG. 2, for providing a cylindrical running surface 86 for the pressure applying sleeve 78. Cylindrical surface 86 defines a cylindrical opening 88. The compression housing 84 seals off against the upper surface of cavity plate 62 and provides the requisite force to hold the cavity plate 62 in seal off position with the upper plate 38. If desired, the compression housing 84 may include a vent hole 90 for applying a vacuum to the cavity 64 prior to the time the charge hole 17 slides into communication with the opening of bushing 60 and cavity 64. The vacuum may be drawn on the cavity 64 before and while molten metal is being elevated into the cavity space 64.

The final product 70 includes a cylindrical sidewall 92 preferably less than one-eighth of an inch in thickness, and more preferably about three thirty-seconds of an inch, and an integral disk shaped divider 94 at a right angle to the sidewall 92 about one-third of the way up the sidewall 92. The product 70 is preferably formed of lead and preferably is a relatively large tubular battery terminal. The product 70 is free of cracks, voids, pores and laminations and includes a smooth finish. Typically, material is introduced slightly in excess to the cavity 64 to have material to which to apply pressure before reaching the final shape or dimension. This material is the upper surface of the cylindrical sidewall 92 which has been engaged by the sleeve end 82. This upper surface is then machined off. It should be noted that this excess material may be cold extruded through a small orifice at the parting line or plane between the lower surface of the compression housing 84 and the upper surface of the cavity plate 62. Such permits the sleeve 78 to form the finished part to the dimension desired. Such is accomplished by opening a gate valve at the end of solidification.

Now that the construction of the molding apparatus according to the teachings of the preferred embodiment of the present invention has been set forth, subtle features and advantages of the preferred construction of the present invention can be noted.

In operation, as shown in FIG. 1, the charge 18 is loaded into the shuttle 16 below the surface 37 of the molten or semi-molten material 15. The molten material 15 enters the charge hole 17 from below the shuttle 16 and rises into the charge hole 17 from the bottom of the charge hole 17. The shaft 36 closes almost immediately after the molten material 15 begins to rise into the hole 17 to minimize exposure of the charge 18 to the atmosphere. When the molten material in the hole 17 rises to be substantially flush with the upper surface of the shuttle 16, the shuttle 16 is slid in the direction of the punch and mold cavity assembly 12. As the shuttle 16 thus slides, the shuttle plate portion 40 seals the beveled intake 28. The shuttle 16 slides relatively slowly toward the assembly 12 to minimize turbulence in the shot or charge 18 being transferred. At about the same time as the shuttle 16 slides to the assembly 12, the upper punch 52 is driven downwardly by the plate 68, through the opening 88 and into the cavity 64 such that the head 57 comes to rest about two-thirds of the way into the cavity 64.

The shuttle 16 slides such that the charge hole 17 is aligned with the vertical axis of the lower punch 50 and such that central axis of the charge hole 17 is aligned with central axes of the bushings 58 and 60, as shown in FIG. 2. In such a position the charge 18 lies on the head 56 of the punch 50. Then the punch 50 is driven upwardly by the mount 54 sufficiently slowly so as not to induce turbulence in the charge 18. As the charge is driven upwardly, the bushing 60 meters the desired amount of molten material of the charge 18 into the cavity 64. As shown in FIG. 3, the diameter of the punch 50 may be slightly smaller than the diameter of the charge hole 17 such that the assembly 12 is operable without a precise alignment of the hole 17 with the bushings 58 and 60. Accordingly, a small amount of molten material may be left in the charge hole 17 after the punch 50 has been elevated into the bushing 60. As the punch 50 elevates the charge 18 into the cavity 64, the portions of the charge 18 flow horizontally onto the upper annular surface of the bushing 60, against the head 57 of the upper punch 52, and vertically into the cavity 64 against and between cylindrical surface 66 and the cylindrical surface of the upper punch 52. Such an elevation of the charge 18 occurs with little or zero turbulence. The upper punch 52 is set in position prior to the time when it is engaged by the charge 18. The lower punch 50 is driven upwardly past the upper surface of the upper plate 38 and comes to rest such that the heads 56, 57 of the punches 50, 52 are spaced slightly apart. The upper punch 52 preferably does not put any pressure on the charge 18 prior to the descent of the sleeve 78.

As shown in FIG. 4, after the charge 18 has been elevated into the cavity 64, the sleeve 78 is driven downwardly by the pins 74 and plate 76 to apply pressure in the range from 20,000 psi to 60,000 psi to the charge 18. Pressure is maintained throughout the cooling cycle until the charge 18 solidifies to the final product 70 to eliminate shrinkage and produce a dense air free casting. Then the sleeve 78 and upper punch 52 may be retracted, and the compression housing 62 is removed, whereupon the punch 50 is driven further upwardly to displace the final product 70 from the cavity 64. The punch 50 is then retracted back through the bushing 60 and the charge hole 17 and the compression housing 84 is placed back on the cavity plate 62.

Subsequently the shuttle 16 slides in the direction of the reservoir 14. At the time the charge hole 17 comes into communication with the vent hole 32, the shaft 36 is raised to permit any air in the charge hole 17 to be eliminated through the outlet 34. The shaft 36 is then lowered to close off the outlet 34. At about this time, molten material 15 begins to rise into the charge hole 17.

The above method described in detail can be more generally described as the steps of feeding without pouring a charge 18 of molten material to a first location below the mold cavity 64 and between the punch 50 and the mold cavity 64; then elevating with the punch 50 the charge 18 of molten material from the first location into the mold cavity 64; and then applying pressure to the molten material in the mold cavity 64 substantially immediately to solidify the molten material under pressure, minimize the formation of skin, and maximize the formation of a smooth finish on the product.

The pressure is applied by the sleeve 78 before solidification of any of the molten material occurs in the cavity 64 or against the wall 66 or the surfaces of the punches 50, 52. Premature solidification is eliminated as the sleeve 78 contacts the charge 18 almost immediately after the charge 18 has been elevated fully into the cavity 64, i.e. when vertical travel of the punch 50 is ceased by the mount 54. The time between such is preferably less than one-quarter (0.25) of a second, more preferably less than one-fifth (0.20) of a second, still more preferably less than one-tenth (0.10) of a second, and still more preferably less than one-hundredth (0.010) of a second. Typically, such a time averages about one-fifth (0.20) of a second.

The present method of the charge 18 being tapped from the reservoir 14, slid via the shuttle 16 to the assembly 12, and elevated into the cavity 64 occurs substantially in an environment free of air. A vacuum may be applied to both vent holes 90 and 32.

That the charge 18 includes minimal or zero turbulence from the time the molten material enters the charge hole 17 until the final product 70 is formed. The molten material 15 rises, instead of being poured or flowing downwardly, into the charge hole 17. The shuttle 16 slides relatively slowly to the assembly 12 to prevent turbulence or splashing and without the disc shape charge 18 changing in form. The charge 18 is elevated relatively slowly by the punch head 56 to prevent turbulence or splashing. The bushing 60 meters the charge 18 with minimal change in form. As the charge 18 is elevated into the cavity 64, the charge may flow horizontally only to a minimal extent Downward flow in the cavity 64 is avoided. Accordingly, with little or zero turbulence, an air-free product is produced.

The charge 18 is not pressurized during any step of the method and all steps of the method convey the charge 18 along either vertical or horizontal routes. Downward movement or flow or a pouring of the molten material is avoided to minimize the creation of turbulence and air pockets in the charge 18. The method is carried out at atmospheric pressure conditions.

The molten material is in the molten state in the reservoir 15, in the charge 18, and in the cavity 64 until pressure is applied by the sleeve 78. The charge 18 is maintained as long as possible in a single form without a change in shape to maximize the retention of heat. The shape of a disk is preferred. As heat is retained, the formation of skin or the formation of lamination is minimized or eliminated. The molten material 15 is preferably a metal of the group of lead, zinc, and aluminum metals. Lead is the preferred metal.

The charge 18 is metered twice by the present invention. The first metering occurs when the charge hole 17 is filled in the reservoir 14. The second metering occurs when the punch 50 elevates the charge 18 through the bushing 60. Accordingly a precise amount of molten material is delivered to the cavity 64. Still further, since a precise amount of molten material has been delivered the cavity 64, pressure can be applied almost immediately, if not simultaneously with the punch 50 attaining its desired vertical position. There is no need to check the volume of the material delivered to the cavity 64 prior to applying pressure to the charge 18. The quantity of the charge metered and delivered to the cavity 64 is equal to the area of the opening formed by the bushing 60 multiplied by the thickness of the shuttle 16.

The present method may be described as a cold forming method as a smooth finish is provided to the outside of the final product 70.

A complete cycle of the method to make a cup shaped battery terminal takes preferably about 15 seconds, and more preferably about eight seconds. The pressure on the molten metal is brought to bear usually within. 2 seconds or less and is continued on the molten lead until the part has solidified.

For casting of lead battery terminals the particular pressure applied is in the pressure range of 20,000 psi to 60,000 psi. However, the pressure can also depend on the configuration of the product and the type of metal in the charge 18.

Punch 50 elevates the charge 18 sufficiently quickly to minimize the loss of heat from the charge 18 and sufficiently slowly to cause little or zero turbulence in the molten material. The apparatus 10 and the present method may be utilized with liquid such as molten material, including semi-molten material.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A method for molding a battery terminal which is free of cracks or voids in a mold assembly having a mold cavity and at least one punch, the method comprising the steps of:

a) feeding without pouring a charge of molten lead to a first location below the mold cavity and between the punch and the mold cavity; then b) elevating with the punch the charge of molten lead from the first location into the mold cavity; and then c) applying pressure to the molten lead in the mold cavity substantially immediately to solidify the molten lead under sufficient pressure to produce a battery terminal free of cracks or voids.

2. The method of claim 1 wherein the time from the end of the step of elevating the molten lead into the mold cavity to the start of the step of applying pressure to the molten lead is less than one-quarter of a second.

3. The method of claim 1 wherein the step of applying pressure to the molten lead is initiated prior to solidification of any of the molten lead in the cavity.

4. The method of claim 1 wherein the step of applying pressure is initiated when elevation of the punch is ceased.

5. The method of claim 1 wherein the step of elevating includes the step of metering the charge with the punch prior to when the charge of molten lead is elevated into the mold cavity.

6. The method of claim 1 wherein the step of elevating the charge of molten lead includes the step of elevating the charge of molten lead sufficiently quickly to minimize loss of heat from the charge of molten lead and sufficiently slowly to minimize the creation of turbulence in the charge of molten lead.

7. The method of claim 1 wherein the steps of elevating the molten lead into the mold cavity and applying pressure to the molten lead are carried out in an environment substantially free from air.

8. The method of claim 1 further comprising the step of applying a vacuum to the mold cavity during the step of elevating the molten lead into the mold cavity.

9. The method of claim 1 wherein the step of feeding a charge to the first location comprises the step of moving the charge of molten lead without changing the shape of the charge of molten lead, the step of moving including moving the charge from a position out of alignment between the punch and mold cavity to a position aligned between the punch and mold cavity.

10. The method of claim 1 wherein the step of feeding a charge to the first location comprises feeding a charge having the shape of a disc.

11. The method of claim 1 wherein the step of feeding the charge to the first location includes the step of transferring the molten lead from a reservoir of molten lead, the step of transferring the molten lead including the step of taking the molten lead from below the surface of the molten lead in the reservoir to minimize exposure to air of the molten lead to be molded.

12. The method of claim 1 wherein the step of feeding the charge to the first location includes the step of sliding the molten lead from a first reservoir level in a reservoir of molten lead, the first reservoir level being substantially horizontal with or lower than the first location.

13. The method of claim 12 wherein the step of feeding the molten lead includes the step of drawing molten lead up into the first reservoir level in the reservoir from a second level in the reservoir lower than the first reservoir level.

14. The method of claim 1 wherein the pressure applied to the molten lead is within the range of 20,000 to 60,000 p.s.i.

15. A method for molding a product utilizing a mold apparatus having a reservoir of liquid material, a mold cavity, and a shuttle between the reservoir and mold cavity for transferring liquid material therebetween, the process comprising the steps of:

a) loading a charge of liquid material onto the shuttle, the liquid material being loaded upwardly into the shuttle from:

i) below the surface of liquid material in the reservoir to minimize exposure of the liquid material to be molded from exposure to air and ii) below the shuttle to minimize a pouring of the liquid material to thereby minimize turbulence of the liquid material and pores in the product; then b) moving the shuttle from the reservoir to the mold cavity; and then c) molding the liquid material in the mold cavity.

16. A method for molding a product utilizing a mold apparatus having a reservoir of liquid material and a mold cavity, the process comprising the steps of:

a) conveying a charge of liquid material out of the reservoir from below the surface of the liquid material in the reservoir:

i) without pressurizing the liquid material in the reservoir, ii) without pressurizing the charge of liquid material being conveyed out of the reservoir, and iii) without permitting the charge of liquid material being conveyed out of the reservoir to flow downwardly or be poured; then b) bringing without pressurizing the charge of liquid material conveyed out of the reservoir into the mold cavity; and then c) molding the liquid material in the mold cavity.

* * * * *